US007044114B1

(12) United States Patent
Scouten

(10) Patent No.: US 7,044,114 B1
(45) Date of Patent: May 16, 2006

(54) EFFICIENT FUEL DISPERSION DEVICE

(76) Inventor: Douglas G. Scouten, 1414 98th St., Niagara Falls, NY (US) 14304

( * ) Notice: Subject to any disclaimer, the term of this patent is extended or adjusted under 35 U.S.C. 154(b) by 0 days.

(21) Appl. No.: 11/129,964

(22) Filed: May 16, 2005

(51) Int. Cl.
*F15C 1/04* (2006.01)

(52) U.S. Cl. ..... 123/536; 123/538

(58) Field of Classification Search ..... 123/536–538
See application file for complete search history.

(56) References Cited

U.S. PATENT DOCUMENTS

| | | | | |
|---|---|---|---|---|
| 4,203,398 | A * | 5/1980 | Maruoka | 123/701 |
| 4,237,836 | A | 12/1980 | Tanasawa et al. | 123/537 |
| 4,251,031 | A | 2/1981 | Martin et al. | |
| 4,590,915 | A | 5/1986 | Yamauchi et al. | 123/590 |
| 4,594,969 | A * | 6/1986 | Przybylski | 123/25 E |
| 4,930,483 | A | 6/1990 | Jones | 123/538 |
| 5,069,191 | A | 12/1991 | Scouten | 123/538 |
| 5,148,794 | A | 9/1992 | Scouten | 123/538 |
| 5,404,913 | A | 4/1995 | Gilligan | |
| 5,533,490 | A | 7/1996 | Pascall | 123/538 |
| 6,019,092 | A | 2/2000 | Gilligan | 123/538 |
| 6,758,194 | B1 * | 7/2004 | Shetley et al. | 123/557 |

* cited by examiner

*Primary Examiner*—Marguerite McMahon
(74) *Attorney, Agent, or Firm*—Michael L. Dunn

(57) ABSTRACT

A fuel conditioning device for increasing fuel burning efficiency and reducing pollutant emissions. The device includes a hollow housing. The housing in turn includes: i) a first end for receiving a combustible liquid fuel supply and supplying it to an intermediate portion of the housing; ii) an intermediate portion having an eddy chamber for receiving fuel from the first end and creating turbulence and mixing within the fuel, where the eddy chamber is designed for receiving at least one flow diverter for diverting at least a portion of the flow from the first end in a direction at an angle of from about 30 to about 90 degrees to an original direction of flow from the first end; and iii) a second end for receiving a compound venturi for accepting fuel from the intermediate portion. The device also includes at least one flow diverter inserted into the eddy chamber for diverting at least a portion of the flow from the first end in a direction at an angle of from about 30 to about 90 degrees to an original direction of flow from the first end; and includes a compound venturi inserted into the second end of the housing for accepting fuel from the intermediate portion. The compound venturi has a central venturi for accepting a majority of the fuel provided by the intermediate portion and radial venturis for receiving a portion of the fuel from the intermediate portion and directing it in a direction at an angle of from about 30 to about 90 degrees to a longitudinal axis of the central venturi to create turbulence in fuel passing through the central venturi, said compound venturi being provided with an outlet end for connection to a conduit for passing fuel from the central venturi to a fuel combustion chamber. The invention also includes the use of the device to increase engine efficiency and reduce emissions.

7 Claims, 5 Drawing Sheets

EFFICIENT FUEL DISPERSION DEVICE

BACKGROUND OF THE INVENTION

This invention relates to devices for dispersing fuel and more particularly relates to fuel agitating devices commonly used for improving burning efficiency of internal combustion engines.

Originally, internal combustion engines burned at relatively low efficiency causing exhaust of numerous pollutants, e.g. unburned hydrocarbons, low valence nitrogen oxides, such as NO, and carbon monoxide. Such inefficient burning also resulted in wasted fuel, increasing cost and unnecessarily depleting petroleum reserves. Within the last few decades, the importance of increasing fuel efficiency has been recognized. As a result, engines have been developed that operate at higher temperatures, that use computer control of fuel air mixes, both of which have dramatically increased fuel efficiency. In addition, after burning devices have been utilized to reduce pollutants, e.g. in the form of catalytic converters. The result has been a dramatic decrease in pollution from internal combustion engines despite an increase in internal combustion engine use.

Despite the above advances, fuel burning efficiency is still not perfect and there remains significant room for improvement.

Devices that have recently been used to increase burning efficiency are devices that agitate fuel just prior to entry into the cylinder of an internal combustion engine for combustion. Such devices, e.g. as described in U.S. Pat. Nos. 5,069,191 and 5,148,794, have shown promise in increasing fuel burning efficiency, but for several reasons have not been universally adopted. One drawback is that they have been complicated and expensive to manufacture. For example, as shown in U.S. Pat. No. 5,069,191, a complicated grooved insert within a chamber and a complex flanged member requiring alternate ridges and grooves are required. The device described in U.S. Pat. No. 5,148,794 is even more complex. Both of these devices also use a complex, multipart machined housing structure. Despite their complexity, these devices have still not provided improvement in efficiency and reduction in exhaust pollutants as great as desired.

BRIEF DESCRIPTION OF THE INVENTION

In accordance with the invention, there is therefore provided a fuel agitating device of less complex structure that greatly increases fuel burning efficiency while significantly reducing exhaust pollutants.

More particularly, the invention is a fuel conditioning device for increasing fuel burning efficiency and reducing pollutant emissions. The device includes a hollow housing. The housing in turn includes: i) a first end for receiving a combustible liquid fuel supply and supplying it to an intermediate portion of the housing; ii) an intermediate portion having an eddy chamber for receiving fuel from the first end and creating turbulence and mixing within the fuel, where the eddy chamber is designed for receiving at least one flow diverter for diverting at least a portion of the flow from the first end in a direction at an angle of from about 30 to about 90 degrees to an original direction of flow from the first end; and iii) a second end for receiving a compound venturi for accepting fuel from the intermediate portion.

The device also includes at least one flow diverter inserted into the eddy chamber for diverting at least a portion of the flow from the first end in a direction at an angle of from about 30 to about 90 degrees to an original direction of flow from the first end; and includes a compound venturi inserted into the second end of the housing for accepting fuel from the intermediate portion. The compound venturi has a central venturi for accepting a majority of the fuel provided by the intermediate portion and radial venturis for receiving a portion of the fuel from the intermediate portion and directing it in a direction at an angle of from about 30 to about 90 degrees to a longitudinal axis of the central venturi to create turbulence in fuel passing through the central venturi, said compound venturi being provided with an outlet end for connection to a conduit for passing fuel from the central venturi to a fuel combustion chamber.

The invention also includes the use of the device to increase engine efficiency and reduce emissions by insertion of the device in a fuel supply prior to an engine fuel intake.

DETAILED DESCRIPTION OF THE INVENTION

Figure 1:
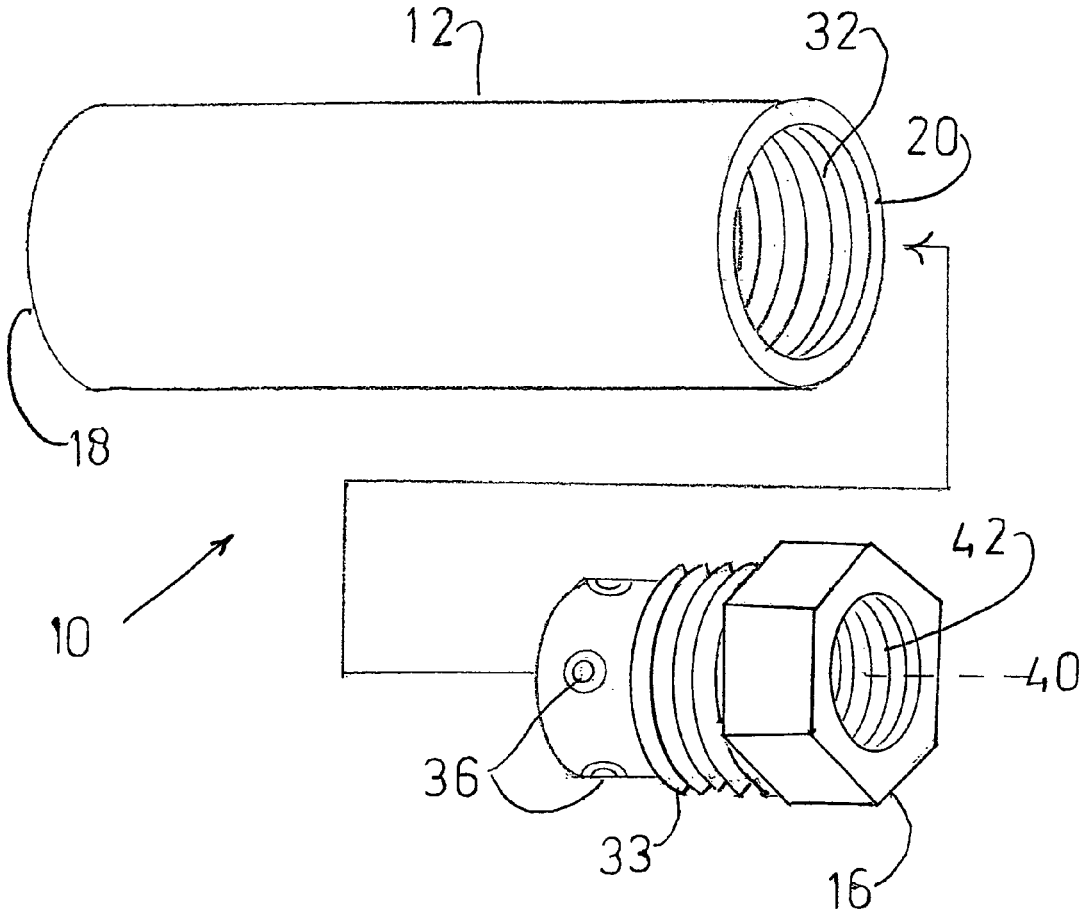
FIG. 1 shows a second end perspective view of the device of the invention showing an exploded view of assembly of the compound venturi used in accordance with the invention.
Figure 2A:
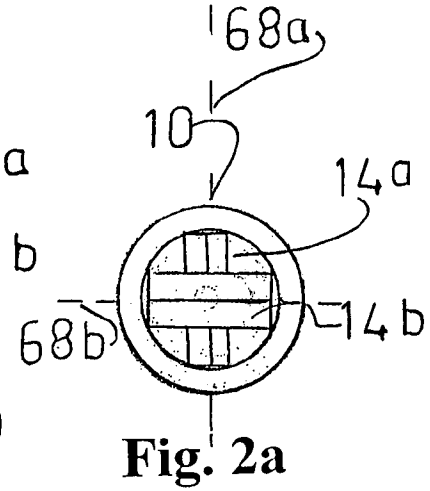
FIG. 2*a* shows a downstream end view of the device of FIG. 2.
Figure 2:
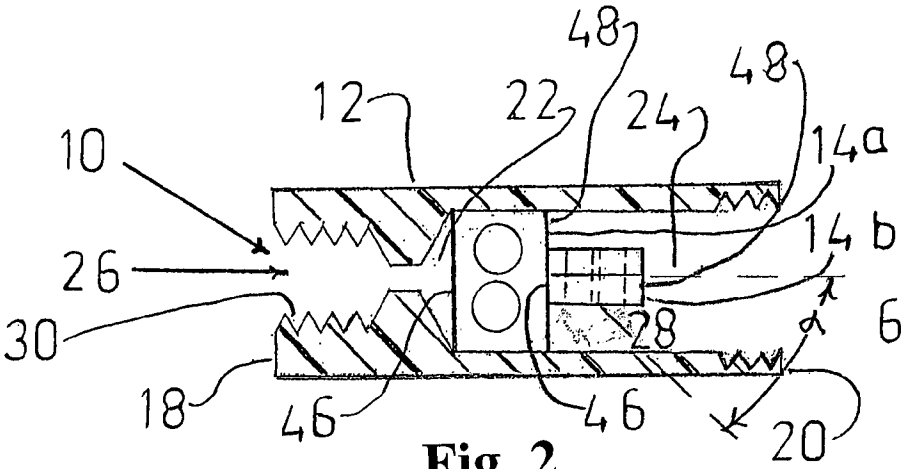
FIG. 2 shows a longitudinal cross sectional view of the device of FIG. 1 with crossed flow diverters and without the compound venturi being assembled.
Figure 3A:
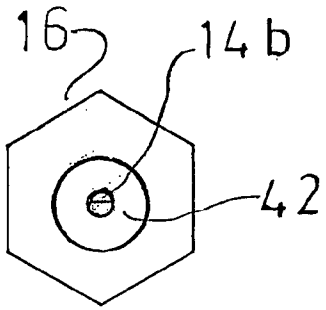
FIG. 3*a* shows a downstream end view of the device of FIG. 3.
Figure 3:
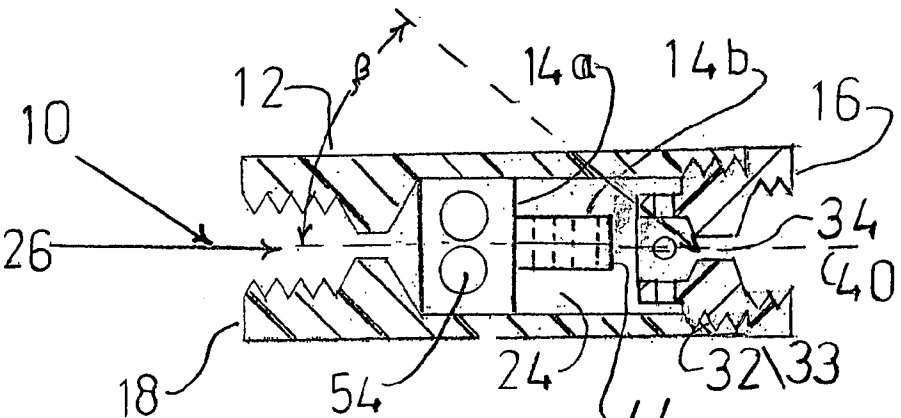
FIG. 3 shows a longitudinal cross sectional view of the device of FIG. 2 with assembled compound venturi.

The fuel conditioning device of the invention for increasing fuel burning efficiency and reducing pollutant emissions uniquely operates through the use of fuel redirecting apparatus, i.e. a flow diverter, that redirects a secondary portion of supply fuel flowing through the device so that it collides with a primary portion of supply fuel flowing though the device creating initial turbulent flow, in combination with a complex venturi that redirects a portion of the initial turbulent flow through at least one secondary venturi to form secondary venturi flow that impinges the balance of the initial turbulent flow either just before or while the balance of the initial turbulent flow passes through a primary venturi. Preferably, the redirecting apparatus redirects the secondary supply fuel portion so that it collides with the primary supply fuel portion at an angle of from about 30 to about 90 degrees and most preferably from about 60 to about 90 degrees.

Similarly, the secondary venturi preferably directs the secondary venturi flow so that it collides with the balance of the initial turbulent flow at an angle of from about 30 to about 90 degrees, and most preferably at an angle of from about 60 to about 90 degrees. Generally a plurality, e.g. 2 to 4, secondary venturis are provided.

The hollow housing, in its simplest form, is a tubular member having first and second ends for connection to a fuel supply line at its first end and for receiving a complex venturi at its second end. For ease in connection, the ends are preferably provided with internal (female) threads.

The flow diverter may be any device that redirects a portion of the flow, as above described, e.g. any structure that accepts flow and reroutes it so that it leaves in a different direction than a direction in which it entered. Such structures may for example be blind boxes or tubes having one open end and one closed end where the flow enters the open end in one direction and exits through one or more side walls in a different direction. Other such structures may be one or more tubular flow directors where flow enters one open end of a bent tubular structure in one direction and is redirected by walls of the tube so that flow exits in a different direction. "Tube" or "Tubular" as used in this context refers to a hollow elongated cylinder or prism. In a preferred embodiment the flow diverter is a hollow block having an open end and a closed end and having a plurality of side walls with openings having central axes that are at from about 30 to about 90 degrees with respect to a line passing from a center of the open end to a center of the closed end. When the flow diverter is inserted into the housing, it is oriented so that the open end faces a first end of the housing such that a portion of fuel entering the eddy chamber (between the housing ends) enters the open end and exits through the flow diverter openings at an angle to fuel flowing around the flow diverters within the eddy chamber. In an even more detailed description of a preferred embodiment, the flow diverter includes a pair of mating pieces, each of which has a sidewall and at least one of which has sidewall openings, the pieces together being provided with, two edge walls and an end wall such that when the pieces are combined, the edge walls and end wall are connected by both sidewalls to form a hollow chamber having an open end with openings in at least one of the sidewalls. Usually, a plurality of flow diverters are provided, each of which has a rectangularly shaped open end with a longitudinal axis and the flow diverters are arranged in series such that the longitudinal axes of the open ends are in intersecting planes.

The compound venturi for insertion into the second end of the housing for accepting fuel from the intermediate portion is a combination of a central venturi for accepting a majority of the fuel provided by the intermediate portion and radial venturis for receiving a portion of the fuel from the intermediate portion and directing it in a direction at an angle of from about 30 to about 90 degrees to a longitudinal axis of the central venturi to create turbulence in fuel passing through the central venturi. The radial venturis may direct flow to the fuel passing through the central venturi either just prior to entry into the central venturi or during passage through the central venturi. "Venturi" as used herein, means a restriction in a fluid conductor causing a pressure drop and an increase in velocity. The compound venturi is provided with an outlet end for connection to a conduit for passing fuel from the central venturi to a fuel combustion chamber.

Reference may be had to the drawings for a more specific description of a preferred embodiment of the invention.

As seen in FIGS. 1, 2, 2*a*, 3 and 3*a*, a preferred device 10 of the invention is provided with a housing 12, a pair of flow diverters 14*a* and 14*b* inserted into the housing 12 at right angles to each other and a compound venturi 16.

The housing 12 includes a first end 18 and a second end 20. The first end 18 receives a combustible liquid fuel supply and supplies it to an intermediate portion 22 of housing 12. The intermediate portion 22 has an eddy chamber 24 for receiving fuel from the first end 18 and creating turbulence and mixing within the fuel. The eddy chamber 24 is designed for receiving at least one flow diverter (14*a*, 14*b*) for diverting the direction 26 of at least a portion of the flow from the first end 18 to a direction 28 at an angle $\alpha$ of from about 30 to about 90 degrees to original direction 26 of flow from the first end 18. The second end 20 is designed to receive the compound venturi 16 for accepting fuel from the intermediate portion 22. The first end 18 of the housing 12 preferably has a female thread 30 for mating with a male thread on a fuel supply line and the second end 20 of the housing 12 preferably has a female thread 32 for mating with a male thread 33 on the compound venturi 16.

The compound venturi 16 includes a central venturi 34 for accepting a majority of the fuel provided by the intermediate portion 22 and radial venturis 36 for receiving a portion of the fuel from the intermediate portion 22 and directing it in a direction 38 at an angle $\beta$ of from about 30 to about 90 degrees to a longitudinal axis 40 of the central venturi 34 to create turbulence in fuel passing through the central venturi 34, said compound venturi 16 being provided with an outlet end 42 for connection to a conduit for passing fuel from the central venturi to a fuel combustion chamber.

The flow diverter 14*a*, 14*b* preferably includes a hollow block 44 formed by block halves 44*a*, 44*b* when assembled together forming block 44 having an open end 46 and a closed end 48 and having a plurality of side walls 50, 52 with openings 54 having central axes 56 that are at from about 30 to about 90 degrees with respect to a line (longitudinal axis) 58 passing from a center of the open end 46 to a center of the closed end 48. The open end 46 faces said first end 18 of the housing such that a portion of fuel entering the eddy chamber 24 enters the open end 46 and exits through the flow diverter openings 54 at an angle $\alpha$ to fuel flowing around the flow diverters 14*a*, 14*b* within the eddy chamber 24.

Figure 6:
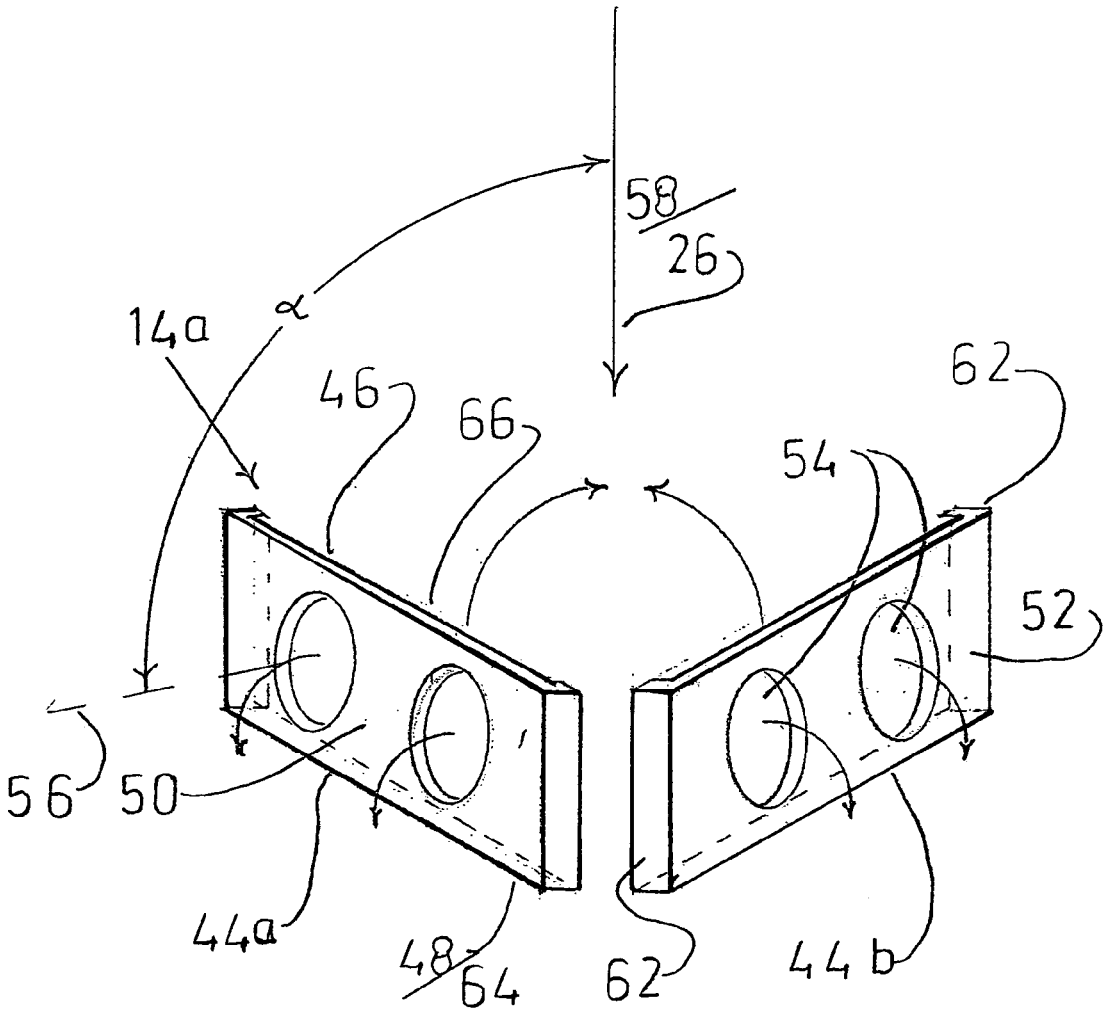
FIG. 6 shows a perspective assembly of a flow diverter for use in the device of the invention as seen in FIGS. 2, 2*a*, 3 and 3*a*.

In the preferred embodiment shown, as best seen in FIG. 6, the flow diverters include a pair of mating pieces 44*a*, 44*b*, each of which has a sidewall 50, 52 and at least one of which has sidewall openings 54, the pieces together being provided with, two edge walls 62 and an end wall 64 such that when the pieces 44*a*, 44*b* are combined, the edge walls 62 and end wall 64 are connected by both sidewalls 50, 52 to form a hollow chamber 66 having an open end 46 with openings 54 in at least one of the sidewalls 50, 52.

In the embodiment shown in FIGS. 1, 2, 2*a*, 3 and 3*a*, the device is provided with a plurality of flow diverters 14*a*, 14*b*, each of which has a rectangularly shaped open end 46 with a longitudinal axis 58 and the flow diverters 14*a*, 14*b* are arranged in series such that the longitudinal axes 58 of the open ends 46 are in intersecting planes 68*a*, 68*b*.

Figure 7:
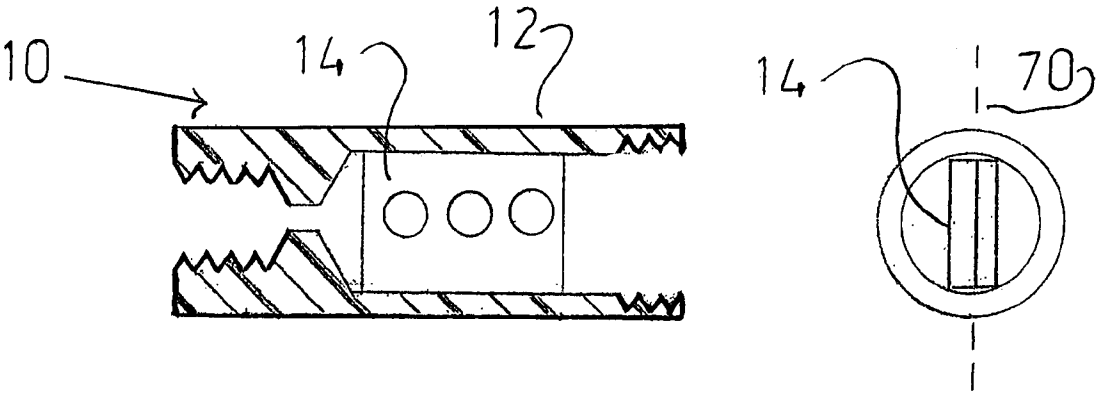
FIG. 7 shows a cross sectional view of a device in accordance with the invention using a flow diverter in planar rather than crossed configuration.
Figure 8:
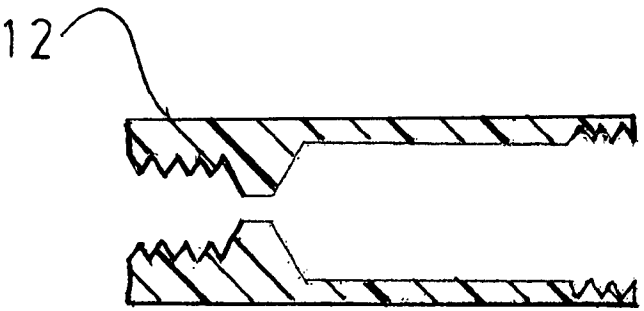
FIG. 8 shows a cross sectional view of a housing used in the assembly of the invention.

The embodiment shown in FIG. 7 is an embodiment according to the present invention except for utilizing one or more flow diverters 14 arranged in a single plane 70.

Figure 4:
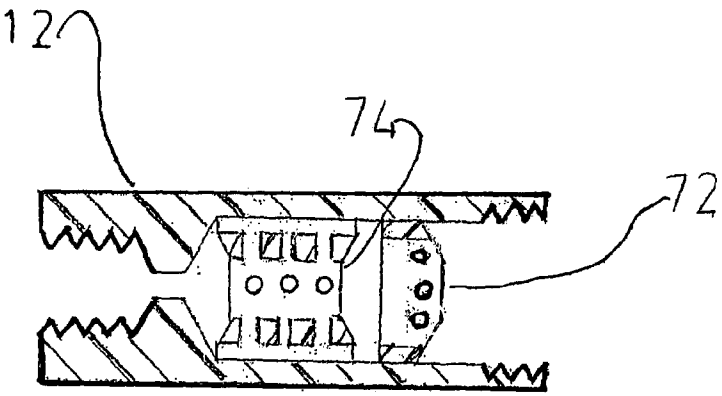
FIG. 4 shows a device having an internal perforated cylinder and conical flow diverter for purposes of comparison with the device of the invention.
Figure 5:
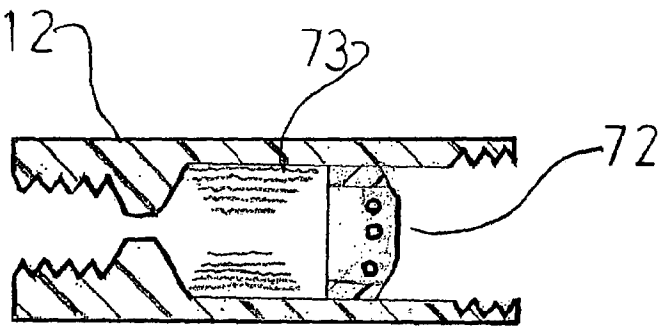
FIG. 5 shows a device having an internal rolled screen and conical flow diverter for purposes of comparison with the device of the invention.

FIGS. 4 and 5 show fuel conditioning devices for purposes of comparison showing that the device of the invention results in better combined fuel efficiency and pollution reduction that other envisioned possible configurations.

The embodiments shown in FIGS. 4 and 5 do not use the unique flow diverters of the present invention and as can be seen from the tables below, do not result in fuel efficiencies and pollution reductions as good as the claimed device. The devices in FIGS. 4 and 5 are otherwise similar in many respects to the devices of the invention. Instead of the unique flow diverter configurations of the present invention, the devices of FIGS. 4 and 5 use a down stream baffle 72 having a cone shaped portion and a plurality of holes. In addition, the device of FIG. 4 utilizes a cylinder 74 with holes, in the eddy chamber, in an attempt to increase turbulence. The device of FIG. 5 additionally uses a wrapped screen 73 in an attempt to increase turbulence.

The device of the invention of FIG. 1 was tested for exhausted unburned hydrocarbons, exhausted carbon monoxide and exhausted nitrogen oxides in comparison with the devices shown in FIGS. 4 and 5 and in addition, in comparison with a unit using only the cone-shaped portion (cone). All units included a compound venturi 16. The test was conducted for 40 km/hr and curb idle emissions in accordance with ASTM test 2525/curb idle emissions using a 1992 5.7 liter Chevrolet C1500 pickup truck. The results are shown in Table 1.

TABLE 1

| Gas Type | Device | 40 km/hr Trial 1 | 40 km/hr trial 2 | Average | Ranking 1 = lowest 2 = highest |
|---|---|---|---|---|---|
| HC ppm | FIG. 1 | 32 | 32 | 32 | 2 |
| | FIG. 5 | 32 | 30 | 31 | 1 |
| | Cone | 37 | 39 | 38 | 4 |
| | FIG. 4 | 32 | 35 | 33.5 | 3 |
| | None | 37 | 42 | 39.5 | 5 |
| CO % | FIG. 1 | 0.01 | 0.01 | 0.01 | — |
| | FIG. 5 | 0.01 | 0.01 | 0.01 | — |
| | Cone | 0.01 | 0.01 | 0.01 | — |
| | FIG. 4 | 0.01 | 0.01 | 0.01 | — |
| | None | 0.01 | 0.01 | 0.01 | — |
| NO ppm | FIG. 1 | 208 | 212 | 210 | 1 |
| | FIG. 5 | 240 | 262 | 251 | 4 |
| | Cone | 245 | 280 | 262.5 | 5 |
| | FIG. 4 | 228 | 248 | 238 | 3 |
| | None | 238 | 234 | 236 | 2 |

TABLE 2

| Gas Type | Device | Curb Idle | Curb Idle | Average | Ranking |
|---|---|---|---|---|---|
| HC ppm | FIG. 1 | 31 | 84 | 57.5 | 2 |
| | FIG. 5 | 54 | 68 | 61 | 4 |
| | Cone | 40 | 65 | 52.5 | 1 |
| | FIG. 4 | 74 | 46 | 60 | 3 |
| | None | 69 | 81 | 75 | 5 |
| CO % | FIG. 1 | 0.01 | 0.08 | 0.045 | 2.5 |
| | FIG. 5 | 0.04 | 0.13 | 0.085 | 4.5 |
| | Cone | 0.01 | 0.03 | 0.025 | 1 |
| | FIG. 4 | 0.08 | 0.01 | 0.045 | 2.5 |
| | None | 0.03 | 0.14 | 0.085 | 4.5 |

| Device | Total Ranks | Avrge. Rank | Overall Rank |
|---|---|---|---|
| FIG. 1 | 7.5 | 1.9 | 1 |
| FIG. 5 | 13.5 | 3.4 | 3 |
| Cone | 11 | 2.8 | 2 |
| FIG. 4 | 11.5 | 2.9 | 4 |
| None | 14.5 | 3.6 | 5 |

It is clear from the results shown in the tables that the use device of FIG. 1 (the device of the invention) is vastly superior in efficiency and reduction of emissions than when the device is not used. It is further clear that the use of the device of the invention gives superior results when compared with the other devices tested.

What is claimed is:

1. A fuel conditioning device for increasing fuel burning efficiency and reducing pollutant emissions comprising:

a) a hollow housing, said housing including:

i) a first end for receiving a combustible liquid fuel supply and supplying it to an intermediate portion of said housing;

ii) an intermediate portion comprising an eddy chamber for receiving fuel from the first end and creating turbulence and mixing within the fuel, said eddy chamber being designed for receiving at least one flow diverter for diverting at least a portion of the flow from the first end in a direction at an angle of from about 30 to about 90 degrees to an original direction of flow from the first end; and iii) a second end for receiving a compound venturi for accepting fuel from the intermediate portion;

b) at least one flow diverter inserted into the eddy chamber for diverting at least a portion of the flow from the first end in a direction at an angle of from about 30 to about 90 degrees to an original direction of flow from the first end; and c) a compound venturi inserted into the second end of the housing for accepting fuel from the intermediate portion, said compound venturi comprising a central venturi for accepting a majority of the fuel provided by the intermediate portion and radial venturis for receiving a portion of the fuel from the intermediate portion and directing it in a direction at an angle of from about 30 to about 90 degrees to a longitudinal axis of the central venturi to create turbulence in fuel passing through the central venturi, said compound venturi being provided with an outlet end for connection to a conduit for passing fuel from the central venturi to a fuel combustion chamber.

2. The device of claim 1 wherein the first end of the housing has a female thread for mating with a male thread on a fuel supply line.

3. The device of claim 1 wherein the second end of the housing has a female thread for mating with a male thread on the compound venturi.

4. The device of claim 1 wherein the flow diverter comprises a hollow block having an open end and a closed end and having a plurality of side walls with openings having central axes that are at from about 30 to about 90 degrees with respect to a line passing from a center of the open end to a center of the closed end, and said open end faces said first end of the housing such that a portion of fuel entering the eddy chamber enters the open end and exits through the flow diverter openings at an angle to fuel flowing around the flow diverters within the eddy chamber.

5. The device of claim 4 wherein the flow diverter comprises a pair of mating pieces, each of which has a sidewall and at least one of which has sidewall openings, the pieces together being provided with, two edge walls and an end wall such that when the pieces are combined, the edge walls and end wall are connected by both sidewalls to form a hollow chamber having an open end with openings in at least one of the sidewalls.

6. The device of claim 5 wherein a plurality of flow diverters are provided, each of which has a rectangularly shaped open end with a longitudinal axis and the flow diverters are arranged in series such that the longitudinal axes of the open ends are in intersecting planes.

7. A method for reducing emissions from an internal combustion engine comprising placing the device of claim 1 in a fuel supply before a fuel intake of the engine.

* * * * *